United States Patent [19]

Evans et al.

[11] 4,015,523

[45] Apr. 5, 1977

[54] METHOD AND APPARATUS FOR FEEDING AND PRINTING DOCUMENTS

[75] Inventors: Robert H. Evans; Ronald F. Wochinski, both of Palatine, Ill.

[73] Assignee: AES Technology Systems, Inc., Elk Grove Village, Ill.

[22] Filed: Jan. 24, 1973

[21] Appl. No.: 326,395

Related U.S. Application Data

[63] Continuation-in-part of Ser. No. 285,608, Sept. 1, 1972, abandoned.

[52] U.S. Cl. ..... 101/233; 101/242; 271/10; 271/110; 271/114; 271/227; 271/245

[51] Int. Cl.[2] ..... B41F 13/24; B65H 7/20

[58] Field of Search ..... 271/3–7, 271/10, 12, 110, 111, 114, 118, 227, 235, 236, 237, 242, 243, 244, 245, 246, 258, 259; 101/233, 242

[56] References Cited

UNITED STATES PATENTS

| | | | |
|---|---|---|---|
| 2,211,765 | 8/1940 | Davidson | 271/3 X |
| 2,759,729 | 8/1956 | Hedlun | 271/110 X |
| 2,903,133 | 9/1959 | Quinn et al. | 271/110 X |
| 3,025,771 | 3/1962 | Uchida | 271/259 X |
| 3,072,397 | 1/1963 | Kelchner | 271/245 |
| 3,191,526 | 6/1965 | Ross | 101/233 X |
| 3,244,417 | 4/1966 | Dammeier | 271/227 |
| 3,300,208 | 1/1967 | Wright | 271/243 |
| 3,747,918 | 7/1973 | Margulis et al. | 271/4 |

*Primary Examiner*—Evon C. Blunk
*Assistant Examiner*—Bruce M. Stoner, Jr.
*Attorney, Agent, or Firm*—Dressler, Goldsmith, Clement, Grodon & Shore

[57] ABSTRACT

A document feeding apparatus sequentially feeding documents, including an automatic feeder for removing one document at a time from a stack and for delivering each document to a feed path. An endless conveyor moves each document along the path towards a document aligning gate means that temporarily interrupts the movement of the documents to effect desired alignment thereof. The automatic feeder and the document aligning gate are automatically controlled so that the documents are selectively removed from the stack as a function of the preceding document moving along the path. A pair of printing heads are positioned along the path and are respectively actuated in response to movement of the documents so that the documents can be printed at accurately positioned locations on a surface thereof.

17 Claims, 12 Drawing Figures

METHOD AND APPARATUS FOR FEEDING AND PRINTING DOCUMENTS

REFERENCES TO RELATED APPLICATION

This application is a continuation-in-part of application Ser. No. 285,608, filed Sept. 1, 1972, now abandoned.

BACKGROUND OF THE INVENTION

The present invention relates to document feeding mechanisms and more particularly to a document feeding device for automatically feeding documents in seriatim to printing means where the documents are automatically printed with suitable indicia.

The use of automatic feeding devices for controlling the movement of documents for numerous types of operations has been known for many years. However, the devices presently known are either extremely expensive and/or of the fixed type so that no changes can be made with respect to the feeding rate for the document or the size of documents that can be automatically fed along a path.

SUMMARY OF THE INVENTION

The present invention provides a simple and inexpensive mechanism that can readily be utilized for feeding documents of various sizes at various different feeding rates to printing mechanism that automatically print indicia on the document.

The feeding device of the present invention consists of feeding means for sequentially feeding documents from a source or stack to a path which is defined by an endless moving conveyor. Gate means are located along the path for temporarily interrupting the documents to align the leading edges transversely or normal to the path. Signal means in the form of a single switch located between the feeding mechanism and the gate means automatically de-energizes the feeding mechanism when one document reaches a predetermined position between the feeding mechanism and the gate. The switch or signal means also automatically actuates the gate means to allow a first document to continue along the path after the leading edge has been properly aligned with respect to the path. The circuit between the switch and the gate means incorporates an automatic time delay that can readily be adjusted to set the spacing between the respective documents.

The electric circuit for automatically controlling the feeding of documents, which includes the switch and time delay, also incorporates mechanism that prevent the gate means from being operated before a leading document reaches a predetermined position downstream of the path and mechanism to automatically interrupt the automatic feeding when the stack of documents or the source is depleted.

According to one aspect of the invention, the feeding means incorporates mechanism that prevents more than one document from entering the path during each operation of the feeding means. This mechanism is in the form of a serrated surface that defines teeth adjacent a drive roller and the spacing between the tips of the teeth and the surface of the roll is approximately equal to the thickness of the document to be fed. Thus, if two documents simultaneously enter the nip area of the roll, the teeth will produce sufficient frictional drag on the second document to prevent the second document from passing through the nip area of the roll.

In one embodiment, or conveyor, the endless drive means for moving the documents along the path consists of a a plurality of transversely spaced continuously driven endless belts with a vacuum chamber located adjacent the belts to maintain the documents on the belt. According to a further aspect of the invention, a further driven roller cooperates with the belts adjacent the gate means to insure that the leading edge is driven against the gate means to properly transversely align the leading edges.

In this form of the invention, the documents leaving the gate area are also automatically printed by printing means that are automatically actuated in response to actuation of the gate means to insure that the printing of the document occurs at the same position with respect to each document. The printing means consists of first and second printing mechanisms, each of which includes a printing head and a backup roller.

In another form of the invention, the conveyor means consists of two sets of continuously driven endless belts located above and below the path and the documents are fed between the belts by the feeding means.

In a further form of the invention, the first printing mechanism is located between the feeding means and the gate means and the back-up roll of the first printing mechanism cooperates with a further set of belts to define a first portion of the path while a second and third set of belts define the remainder of the path for the documents.

The entire feeding apparatus is driven by a single constant speed motor, the speed of which may be adjusted to fit the desired needs. Thus, the motor automatically drives the endless belts and the two printing mechanisms at a constant speed.

In one embodiment, the drive motor is connected to the feeding means, the gate means, and the printing heads through friction drives that are engaged when the driven members are released in response to signals received from the electic circuit, which signals are produced as a function of the documents moving along the path.

The drive means with a single motor driven at a constant speed considerably simplifies the overall construction for the mechanism thereby considerably reducing the cost without sacrificing the versatility of the entire unit.

DETAILED DESCRIPTION

Figure 1:
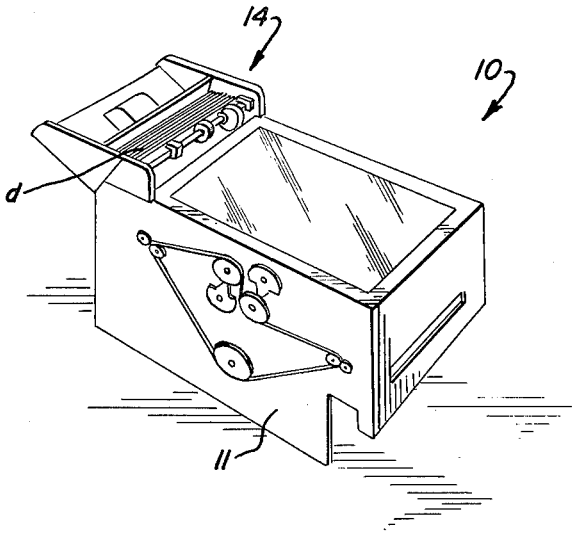
FIG. 1 is a perspective view of the document feeding and printing mechanism of the present invention.

While this invention is susceptible of embodiment in many different forms, there is shown in the drawings and will herein be described in detail several embodiments with the understanding that the present disclosure is to be considered as an exemplification of the principles of the invention and is not intended to limit the invention to the embodiments illustrated.

FIRST EMBODIMENT

Figures 2, 2A:
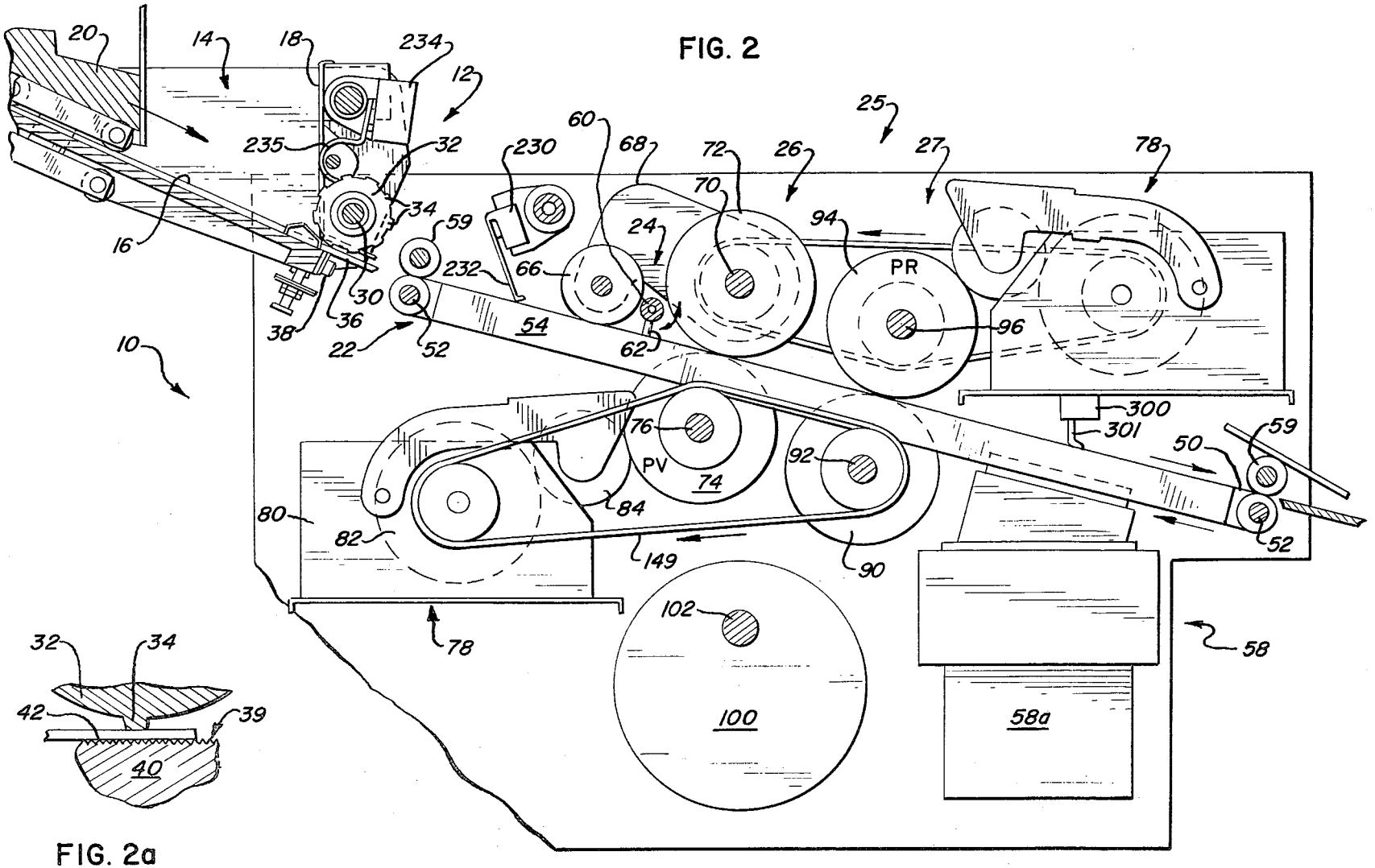
FIG. 2 is a side elevational view, partly in section, showing the various components located along the path for the document.
FIG. 2*a* is an enlarged fragmentary section of the feeding means.
Figure 3:
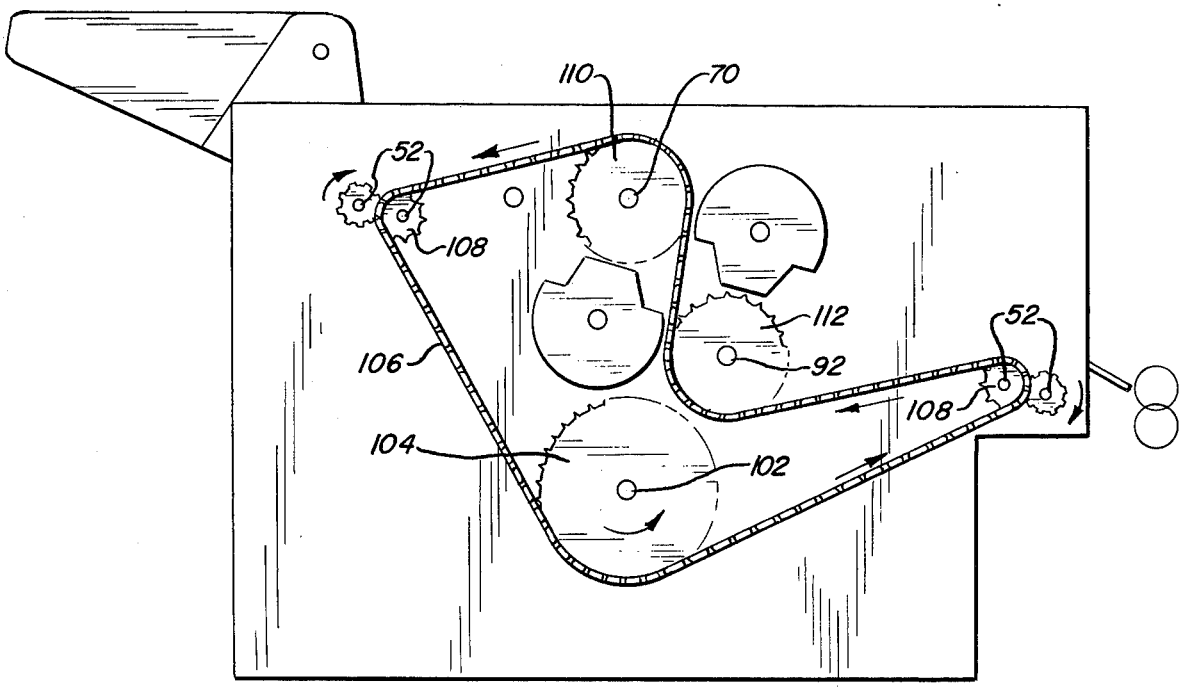
FIG. 3 is a side elevational view of the drive side of the printing mechanism.

FIG. 1 of the drawings generally shows the external appearance of document feeding and printing apparatus or device 10 while FIG. 2 shows a vertical section of the device to show the various components that are enclosed by casing 11. Referring to FIG. 2, feeding and printing device or unit 10 includes a document feeding mechanism consisting of feeding means 12 that is selectively actuated to sequentially feed documents from a source 14 located adjacent one end of unit 10. Document source 14 consists of an inclined trough 16 having vertical forward wall 18 with follower means 20 guided for movement along trough 16 to apply pressure to the trailing end of a stack of documents that are positioned to have opposed surfaces generally parallel to vertical wall 18.

The document feeding device also includes endless belt means 22, gate means 24 and printing means 25. The endless belt means 22 defines a path for the documents with gate means 24 located along the path for temporarily interrupting the movement of the documents for aligning the leading edges generally transversely or normal to the path defined by endless belt means 22.

Printing means 25 is in the form of first and second printing mechanisms 26 and 27, both of which are located downstream of gate means 24.

FEEDING MEANS

Document feeding means 12 consists of shaft 30 rotatably supported on the side walls of trough 16 with a resilient rubber roller 32 secured to the shaft. Resilient roller 32 has circumferentially spaced axially extending projections 34 that define gripping means or a gripping surface for a document, as will be explained later.

According to one aspect of the invention, document feeding means 12 incorporates mechanism that prevents more than one document from entering the path during each operation of the feeding means.

Figure 5:
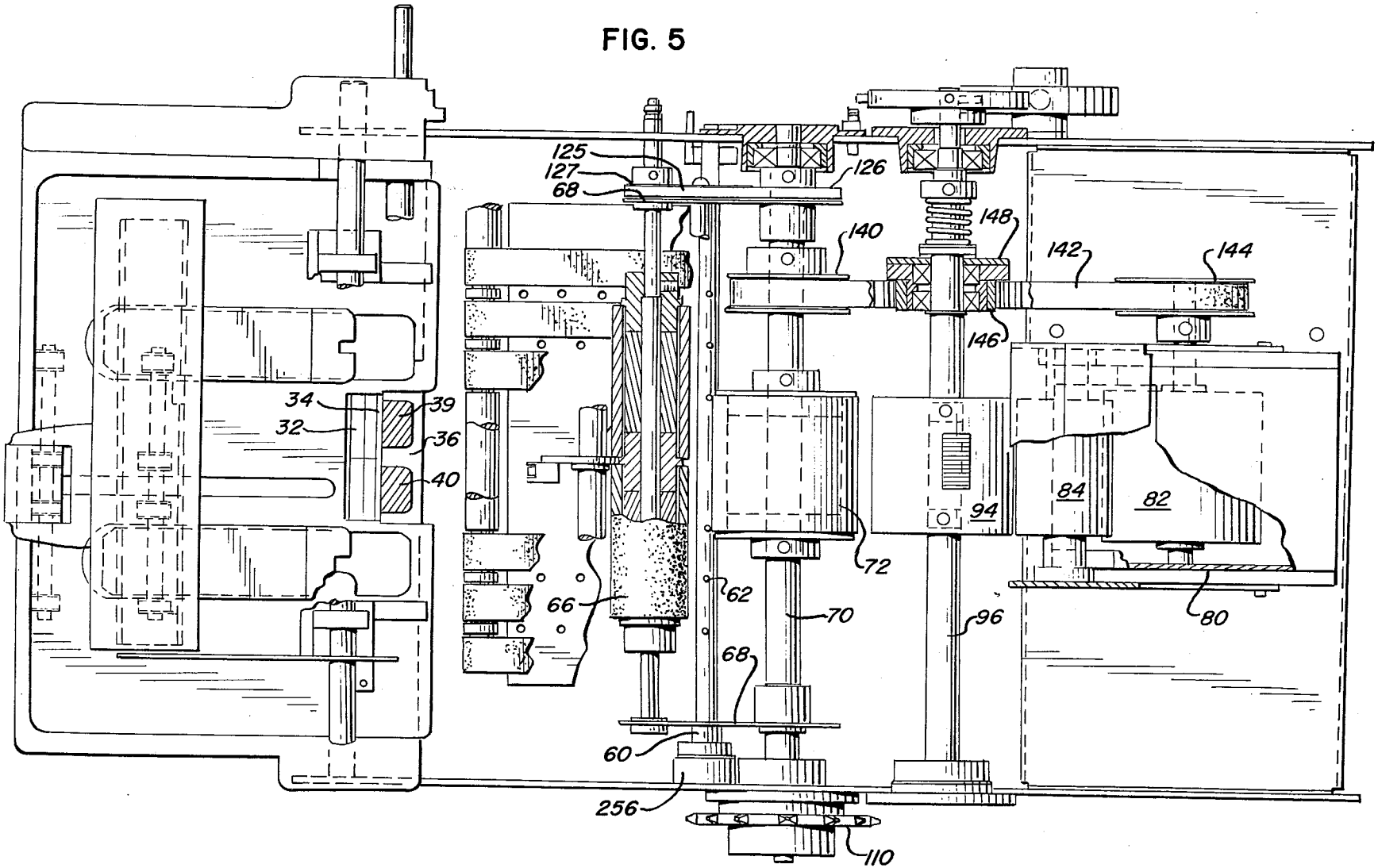
FIG. 5 is an enlarged plan view of the feeding and printing mechanism, with certain parts thereof broken away.

The mechanism for preventing more than one document from entering the path is most clearly shown in FIGS. 2, 2*a* and 5. The mechanism consists of an L-shaped bracket 36 that is fixedly secured to the end of trough 16 through screws 38 and has an upper surface 39 located below the periphery of roller 32. L-shaped bracket 36 supports a pair of serrated elements 40 each of which has a serrated surface exposed adjacent the periphery of roller 32. The serrated surface defines gripping teeth 42 (FIG. 2*a*) exposed to the periphery of the roller. The positioning of serrated elements 40 with respect to the periphery of roller 32 is such that the frictional forces developed between one surface of a document and the periphery of the roller is greater than the frictional forces developed between the other surface of the document and the serrated surface when the single document is located between the nip of the roller and the serrated surfaces.

If two documents are simultaneously located between the nip of the roller and the fixed serrated surface 42 of element 40, the frictional resistance between the serrated surface and the lower document is increased and is greater than the frictional resistance between adjacent surfaces of the two documents, thereby allowing the upper document to be moved to the path while the lower document is held by the serrated gripping surface 42.

It has been found by utilizing elements having a serrated surface similar to a metal file, with a predetermined depth of the serrations, excellent results have been obtained in assuring that only a single document will be fed from the stack or source to the path during each cycle of operation of the feeding means. It can be appreciated that this arrangement is extremely inexpensive for insuring sequential document feeding from the source to the path.

CONVEYOR MEANS

Figure 6:
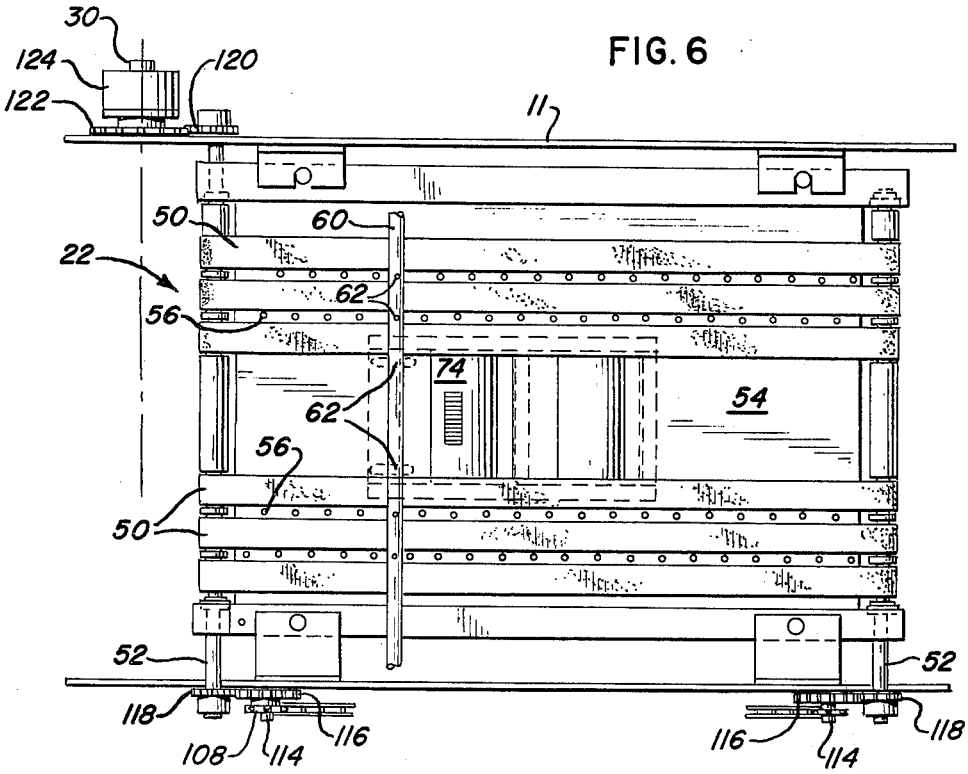
FIG. 6 (with FIG. 1) is a plan view of the endless belt mechanism that defines the document feeding path.
Figure 7:
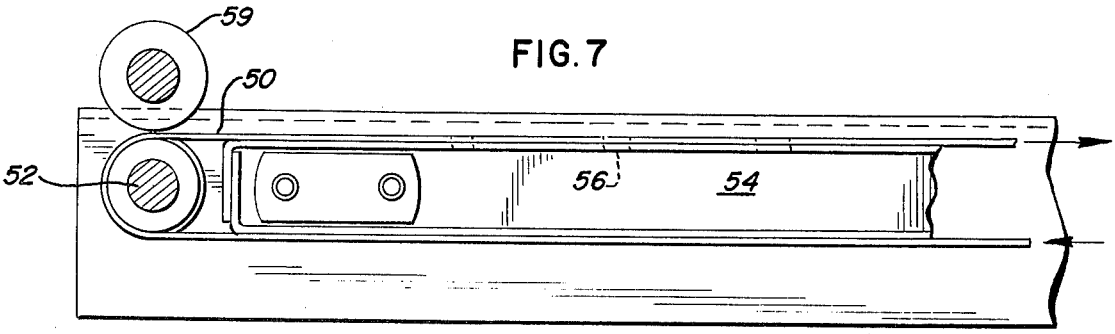
FIG. 7 (with FIG. 1) is an enlarged fragmentary side elevational view of the apparatus shown in FIG. 6.

As was indicated above, endless belt means 22 define the path for the documents that are fed from the stack or source 14. Endless belt means 22 is most clearly shown in FIG. 6 and consists of a plurality of narrow endless belt strips 50 that are entrained over a pair of shafts 52 located adjacent the opposite ends of the path and supported for rotation on casing 11. The adjacent edges of belts 50 are axially spaced with respect to the shafts 52 and a plenum 54 (FIG. 7) has its upper surface located below the lower surface of the upper flight of each of the belts 50. Plenum 54 has a plurality of apertures 56 located between adjacent edges of adjacent belt strips. A vacuum is produced in plenum chamber 54 by vacuum means 58 including vacuum motor 58*a* (FIG. 2), to insure that the documents are maintained on the belt as they are traveling along the path. Endless belt means also has a pair of driven rollers 59 located adjacent shafts 52. Rollers 59 cooperate with shafts 52 and belts 50 to insure that the documents enter and leave the path at opposite ends.

GATE MEANS

Gate means 24 that is located in the path of the moving documents consists of shaft 60 (FIGS. 2 and 6) that is supported on the opposite side walls of the casing 11 for rotation about its axis. Shaft 60 has a plurality of fingers 62 extending therefrom which are fixedly secured to the shaft by suitable means (not shown). The fingers are positioned on the shaft so as to be in alignment with the spaces between the adjacent edges of respective belt strips 50 so that the free ends of the fingers extend below the path defined by the upper surfaces of the upper belt flights. Shaft 60 is periodically rotated by suitable drive means that will be described later.

The fingers 62 define a stop located in the path of movement of the document so that the continuously moving belts 50 will drive the leading edges of the document into engagement with the fingers 62 and insure that the leading edges are transverse or normal to the path for a purpose that will be described later. To insure that the leading edges of the documents engage all of the fingers, additional drive means or a driven roller 66 cooperates with the belt strips adjacent the gate means 24. Driven roller 66 may be in the form of a felt roller that is supported by a pair of plates 68 rotatably supported on a shaft 70 which forms part of the printing means 25 that will be described later. Driven or backup roller 66 is continuously driven by drive means that will be described later.

THE PRINTING MEANS

As was indicated above, the printing means 25 consists of first and second printing mechanisms 26 and 27 which are respectively positioned downstream of gate means 24 to provide suitable indicia on opposed surfaces of the documents being fed. The first printing mechanism 26 consists of backup roll or member 72 support on shaft 70 and located on one side of the path defined by endless belt means 22. Printing head 74 is supported on shaft 76 and is located on the opposite side of the path. The printing head may be inked by first inking means 78 that consists of a tray 80 having a continuously inked pickup roll 82 supported therein with a transfer roll 84 located between the inking roll and the printing head. Again, the drive means for the printing head, the inking mechanism and backup roller will be described later.

The second printing mechanism 27 is substantially identical in construction and again consists of backup roll 90 that is supported on shaft 92 rotated about a fixed axis with respect to the casing and printing head 94 located on the opposite side of the path with second inking means 78 cooperating with printing head 94 to provide the ink for the head.

DRIVE MEANS

According to one aspect of the present invention, the printing and feeding mechanisms are driven by a common drive means consisting of a single motor. The various elements of the drive means are shown in FIGS. 2 through 5 and consist of drive motor 100 having output shaft 102 (FIG. 2). Output shaft 102 has a sprocket wheel 104 (FIG. 3) secured thereto with an endless drive chain 106 entrained over sprocket wheel 104. Endless drive chain 106 is entrained over a pair of driven sprockets 108 respectively located adjacent shafts 52 and further sprockets 110 and 112 respectively connected to the ends of shafts 70 and 92. The sprockets 108 (FIG. 6) are supported on shafts that are rotated on casing 11 and have gears 116 fixedly secured thereto. Gears 116 are in constant mesh with gears 118 so that belt means 22 and backup rollers 72 and 90 are continuously driven when the motor 100 is operating.

Drive motor 100 is also connected to feed means 12 to intermittently drive shaft 30. This connection is made through the shaft 52 that is located adjacent the inlet end to the path and has a gear 120 fixed to the opposite end and in mesh with a further gear 122 that is supported for rotation on shaft 30. The gear 120 is selectively connected to shaft 30 through a clutch 124 in a manner to be described later.

The drive means for roller 66 that cooperates with the document to insure engagement of the leading edge with gate means consists of a belt 125 (FIG. 5) that is entrained over a pulley 126 on shaft 70 and a further pulley 127 on a shaft that supports the roller. Thus, the roller 66 is continuously driven when the motor 100 is operating.

Figure 4:
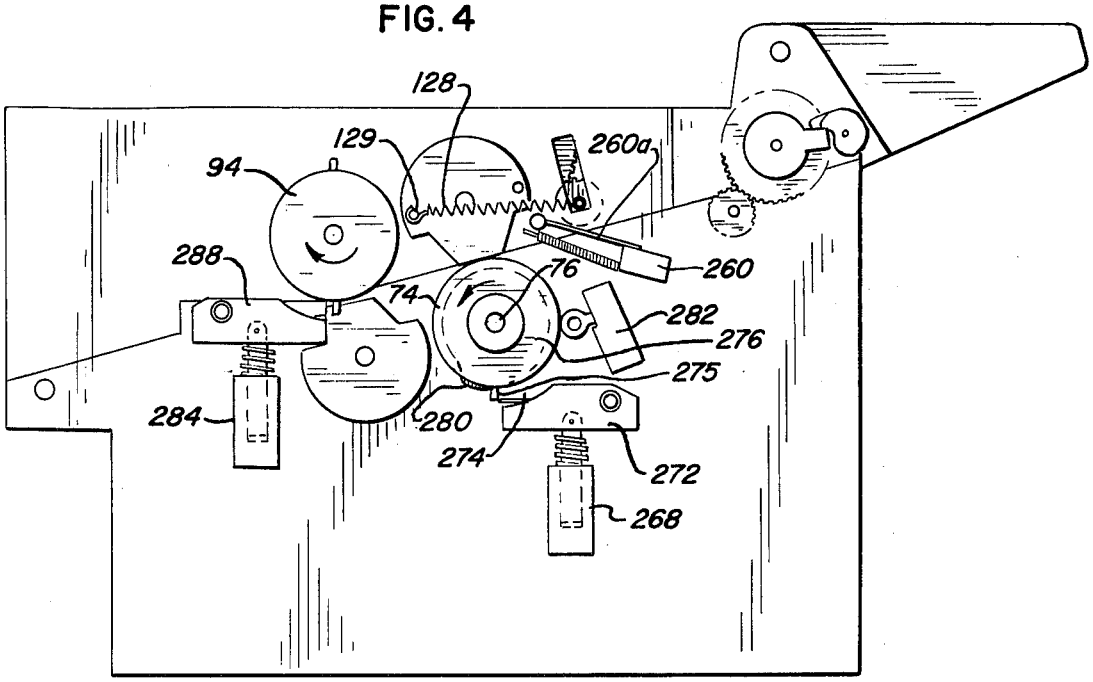
FIG. 4 is a similar view of the opposite side of the device.

As was indicated above, backup roller 66 is pivotally supported on shaft 70 through brackets 68. To insure that the backup roller produces the necessary gripping force with respect to the document, the roller is biased toward belts 50 through spring 128 (FIG. 4). Spring 128 has one end connected to brackets 68 and the opposite end connected to pin 129 carried on casing 11.

First and second printing heads 74 and 94 are driven by respective drive means that are identical in construction, and only one will be described. Referring to FIGS. 2 and 5, shaft 70 has a pulley 140 secured thereto. A belt 142 is entrained over pulley 140 and over pulley 144 that is connected to the shaft leading from inking roll 82, and also passes over the further pulley 146 rotatable with respect to shaft 96. A friction clutch 148 is interposed between pulley 146 and shaft 96 while shaft 96 is normally prevented from rotating by mechanism to be described later.

Thus, belt 142 us continuously driven by shaft 70 through pulley 140 and continuously drives inking roll 82, transfer roll 84 and pulley 146 connected to friction clutch 148. When the shaft 96 is released, the friction clutch 148 connects the pulley 146 to the shaft 96 to effect rotation of the shaft, and of the printing head 94.

Similarly, printing head 74 is intermittedly driven by belt 149 which is continuously driven by a pulley connected to backup roll 90.

ELECTRICAL CIRCUIT

According to the primary aspect of the present invention, the feeding and printing device incorporates an electic circuit that controls all of the components to accurately maintain control of the position of the respective documents along the path as well as the desired spacing between adjacent edges of the respective documents during movement along the path. The electric circuit is shown schematically in FIG. 8.

The electrical circuit consists of power supply 200 which may be connected to feeding circuit in either an automatic or a manual cycle through jog switch 202. Movement of switch 202 to the automatic or "on" position will energized motor 100 and the motor **58*a* forming part of the vacuum means 58, through line 204. An on light 206 will also be energized through line 208. Simultaneously bridge 210 will be energized through lines 212 to 214 to energize document feeding circuit 224 and gate circuit 226. The document feeding circuit 224 has a switch 230 (FIGS. 2 and 8) that has an actuating arm 232 located in the path of movement for the documents. Initially switch 230 is in the position shown in FIG. 8 to complete the circuit to switch 234 which is located adjacent the document stack (FIG. 2) and has an actuating arm 235 that senses the presence or absence of documents. When documents are present, the switch is in the position shown in FIG. 8 while the depletion of the documents will move the switch from the position shown in FIG. 8 to the second position to energize a light 236 to indicate the absence of documents and to automatically render the feeding circuit inoperative. In the position shown in FIG. 8, switch 234 supplies power to line 237 through switches 238 and 239,** that will be described later.

With the invention so far described, the unit is conditioned for initiating the automatic feeding of documents. This is accomplished by actuating manual normally open switch 240 which supplies power to solenoid 242 and relay 244. Solenoid 242 energizes clutch 124 (FIG. 6) to operate the feeding mechanism while relay 244 closes contacts 244-1 to maintain the completed circuit to solenoid 242 and relay 244 after the switch 240 has been released. Actuation of clutch 124 will cause the feeding mechanism to remove one document from the stack in the trough 16 and deliver the document to the path defined by endless conveyor means 22.

The continuous movement of endless conveyor means will move the document along the path and, when the document reaches a position below the switch 230, switch arm 232 will be moved to open the feeding circuit and supply power to line 250 which has time delay 252 therein. Time delay relay forms part of the gate circuit 226 and closes contacts 252-1 a predetermined period after switch 230 has been actuated. The actuation of contacts 252-1 completes the circuit through solenoid 256 to operate gate means 24. This will allow the document to continue its movement along its path for the printing operation. Switch 230 then returns to its original position to condition the feeding circuit for a subsequent operation, to be described later.

The printing operation is actuated in response to operation of the gate means 24. For this purpose, a gate switch 260 (FIG. 4) has its actuating arm 260*a* located in the path of rotation of one of the fingers on shaft 60. Switch 260 is in a line 261 having relay coil 262 therein so that actuation of switch 260 will energize coil 262. Relay coil 262 has its contact 262-1 in printing circuit 264. In its initial position shown in FIG. 8, contact 262-1 completes the circuit to capacitor 265 so that the capacitor is charged when feeding circuit 224 is energized. When switch 260 is actuated, capacitor 265 is connected through a manual normally closed switch 266 to solenoid 268 (see also FIG. 4). Energizing solenoid 268 will cause arm 272 which has stop 274 secured thereto, to move out of engagement with a pin 275 secured to a plate 276 secured to shaft 76 so that the printing head is rotated by the drive means described above.

Actuation of gate switch 260 also initiates the feeding of a subsequent document. For this purpose, document feeding circuit 224 has switch contact 262-2 in parallel with switch contact 244-1 and manual switch 240. Actuation switch 260 by gate means 24 will automatically complete the circuit to clutch 124 to feed a subsequent document to the path as a first document leaves the gate area.

As was indicated above, a second printing head is actuated in response to the actuation of the first printing head. For this purpose, shaft 76 has a cam 280 (FIG. 4) attached thereto behind plate 276 so that rotation of the shaft will actuate a further switch 282 that is located in line 283 (FIG. 8) leading to solenoid 284. Thus, actuation of switch 282 will energize solenoid 284. Actuation of solenoid 284 will move stop arm 288 to allow the second head 94 to be rotated and print the document on the second surface. Relay 262 also simultaneouly closes contact 262-2 in feeding circuit 224 to initiate the feeding of a subsequent document to the path when a first document leaves the gate area.

The circuit for automatically feeding documents also incorporates switch means that prevents the actuation of the gate means if the preceeding document is stalled downstream of the gate means. The switch means is shown in FIG. 2 and consists of a switch 300 having an actuating arm 301 located in the path of movement of the documents. Alternatively, switch 300 may be located in the apparatus into which the documents are being fed to inhibit feeding in the event of a jam occurring in such apparatus.

Switch 300 (FIG. 8) is a normally opened switch and is incorporated in line 302 (FIG. 8) leading to relay 304 which operates its closed contact 304-1, in the gate circuit 226. With this arrangement, after the document has passed through the two printing rolls, switch 300 is actuated to energize relay 304 and hold contact 304-1 open until the document has moved past the position of the switch arm 302. After such time, the contact 304-1 returns to its closed condition so that the gate circuit is conditioned for operation by contacts 252-1.

The electric circuit for the feeding and printing device also incorporates means that allow the unit to be operated manually to feed documents at any desired time through the feeding and printing apparatus. By moving switch 202 to the "jog" position, relay coil 310 is energized which in turn moves contact 310-1 to a second position to cause motors 58*a* and 100 to be energized through line 314. At the same time, relay coil 310 moves 310-2 in line 220 to its second position to complete a direct circuit to relay 256 in the gate circuit while the feeding circuit is interrupted. This will allow the document to be removed from the feed path.

OPERATION

While the operation of the unit has been described above, it is believed that a brief summary appears to be in order.

Power is initially supplied to the entire circuit by moving switch 202 to the on position which conditions the circuit for automatic operation. The initial document is then fed from the stack by momemtarily closing switch 240 that energizes the feeding means 12 and feeds a document from the stack to the path defined by conveyor means 22. When the document reaches the switch arm 232, switch or signal means 230 is actuated to momentarily de-energize the feeding circuit and also energize time delay relay 252. After the predetermined time has elapsed the gate circuit is completed by closing contact 252-1 to operate the gate and allow the document to continue its movement along the path.

It should be noted at this point, that the time delay between actuation of the switch 230 and energizing of the gate circuit is sufficient to allow the document to move into engagement with all of the fingers, insuring that the leading edge thereof is transversely aligned with respect to the path of movement of the documents. In this connection, the spring biased felt roller 66 cooperating with the upper surface of the document insures that the document is moved into engagement with the fingers 62.

The time delay between actuation of switch 230 and the closing of switch contact 252-1 is preferably adjustable from a period of approximately 150 milli-second to ten seconds which perform two distinct and advantageous functions. Assuming that the drive motor 100 is operating at a constant speed, the change in time delay would result in a change in the amount of time between successive operations of the gate means 24. This variation in time may be utilized to vary the spacing between the documents and also to accommodate the documents of different sizes without any change in the compact nature of the unit.

Returning to the actuation of the gate means 24, the actuation of gate means 24 will close switch 260 which will energize relay 262 and simultaneously close contacts 262-1 and 262-2 so that feeding of a subsequent document will be initiated at the same time the printing of the first is initiated.

When the first document leaves the predetermined position downstream of the printing means, defined by switch 300, relay 304 will be de-energized to allow contact 304-1 to close and condition the gate circuit 226 for subsequent operation of the gate after the time delay set in the unit has lapsed.

While the entire feeding mechanism has been described in conjunction with a specific printing mechanism for printing opposed surfaces of the document being fed, it is readily apparent that the feeding mechanism could be used for other distinct purposes any time a predetermined spacing and positioning of the documents with respect to each other is desired.

Also, the illustrated unit has been specifically designed for use with a copying machine and in which the documents are initially fed from the source, printed on opposite sides, and then automatically fed into the copying machine. To utilize this arrangement, the electric ciruit also incorporates certain switches that are incorporated into the copying machine so that the initiation of the automatic feeding can be performed by the proper conditioning of the copying machine. For example, a switch 350 is incorporated into the feeding circuit that will be actuated when the copying machine was ready for receiving copies. This will initiate the automatic feeding of the documents from the source. The two switches 238 and 239 could also be incorporated into the document copying machine so that the feeding of documents would be interrupted when certain conditions of the copying machine are present.

FIG. 9 EMBODIMENT

Figure 9:
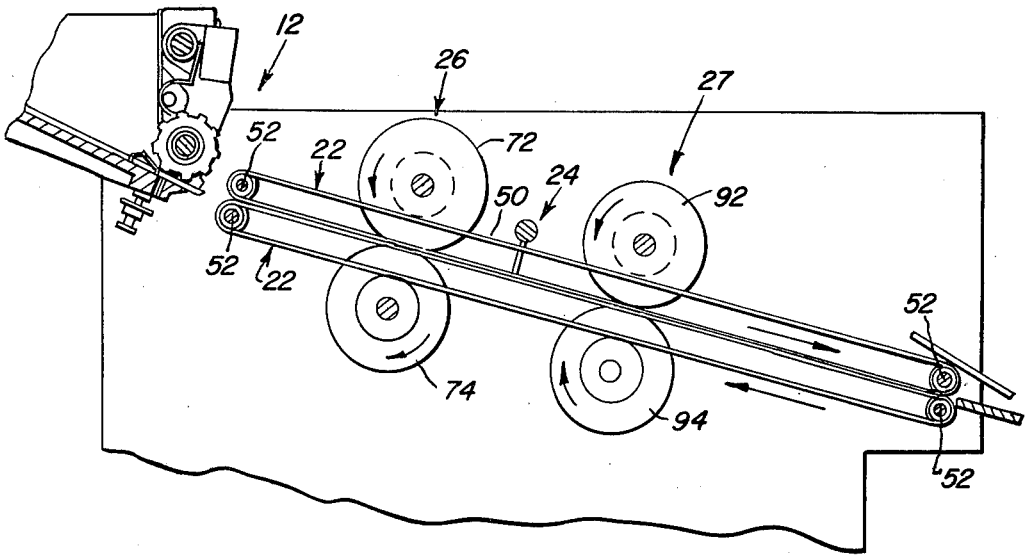
FIG. 9 is a fragmentary side elevational view similar to FIG. 2, showing a slightly modified form of the invention.

A slightly modified form of the invention is shown in FIG. 9 wherein the conveyor means has been modified and the first and second printing mechanism have been relocated, as will now be described. In the modified form of the invention shown in FIG. 9, the vacuum chamber has been deleted and two sets of endless belt means 22 are respectively located above and below the path of the moving documents. Each said set of endless belt means again includes a plurality of belts 50 and the feeding means 12 feeds the documents between the two sets of belts so that they are gripped by the belts and are moved along the path by the continuous movement of the belts 50.

Also, in this embodiment, the first printing mechanism 26 is located between the feeding means 12 and the gate means 24 upstream of the gate means while the second printing means 27 is located downstream of the gate means 24. In this embodiment, the electrical circuit could be revised to have the first printing mechanism actuated in response to actuation of the switch 230 while the second printing means could be actuated in response to actuation of the gate means. In addition, the entire circuit could be modified and incorporate the elements that will be described in connection with the further embodiment shown in FIG. 10.

FIG. 10 EMBODIMENT

Figure 10:
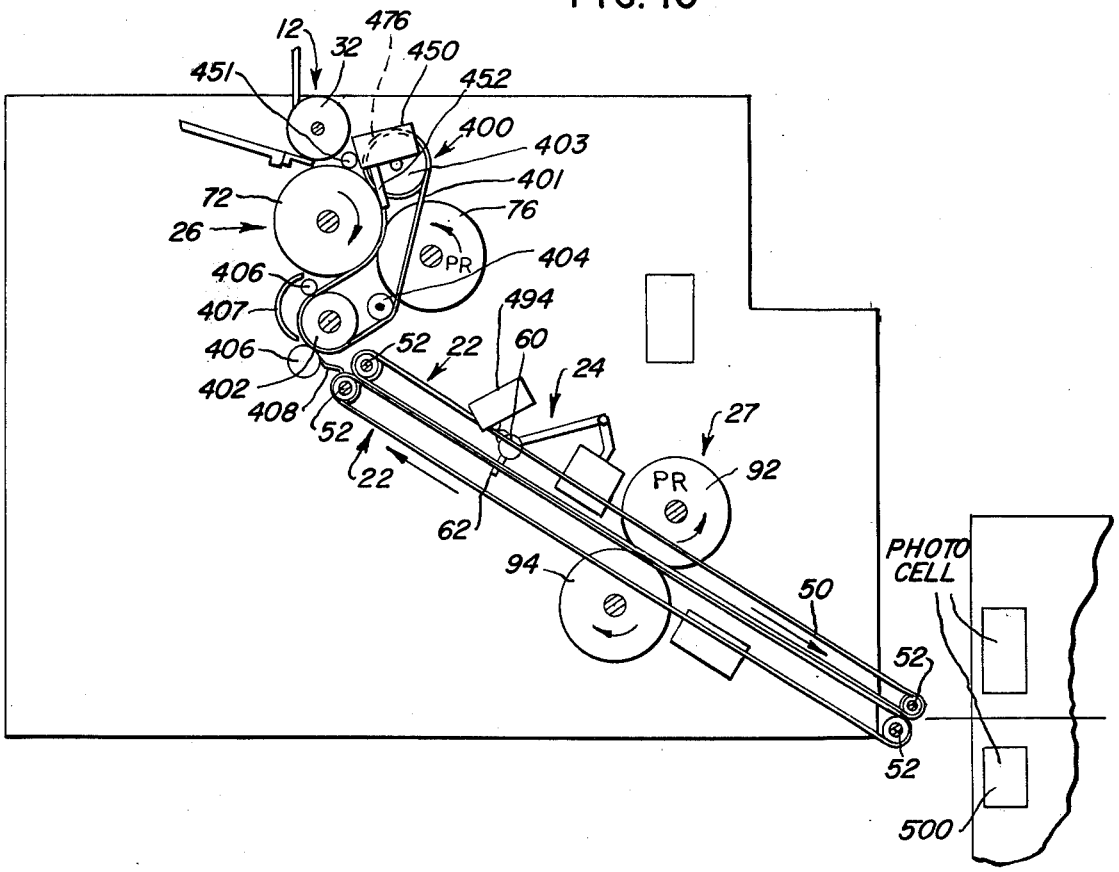
FIG. 10 is a view similar to FIG. 2 showing a further modified form of the invention.

In a further modified embodiment shown in FIG. 10, the conveyor means that defines the path is somewhat modified, and the location of the printing mechanism has been changed. In addition, the modified embodiment incorporates a circuit that is shown in FIG. 11.

In the modified form of the invention, the first printing mechanism 26 is located upstream of the gate means 24 while the second printing mechanism 27 is located downstream of the gate means 24. As in the previous embodiments, the ink is supplied to the printing mechanisms through ink supply means that was described in connection with the embodiment shown in FIG. 2.

In the modification shown in FIG. 10, the conveyor means again includes first and second sets of endless belts 22 each including a plurality of transversely spaced belts 50 that are supported at opposite ends on shafts 52. However, in this embodiment, an additional set of belts 400 is located between the feeding means 12 and the inlet end to the conveyor means defined by the two sets of endless belts 22. The third set of belts 400 consists of transversely spaced belts 401, similar to belts 50, that are entrained over drive roll 402, and a driven roll 403 and an idler roll 404. The belts 401 cooperate with the backup roll 72 that forms part of the printing mechanism 26 and with a pair of rollers 406 that are also located along the path for the documents. In addition, guides 407 and 408 respectively guide the documents between the belts 401 and roller 406 and between the respective sets of belts 50. In this embodiment, the documents are fed from the source between countinuously driven backup roll 72 and belts 401 and then pass between belts 401 and driven rolls 406 to be fed between belts 50.

Figure 11:
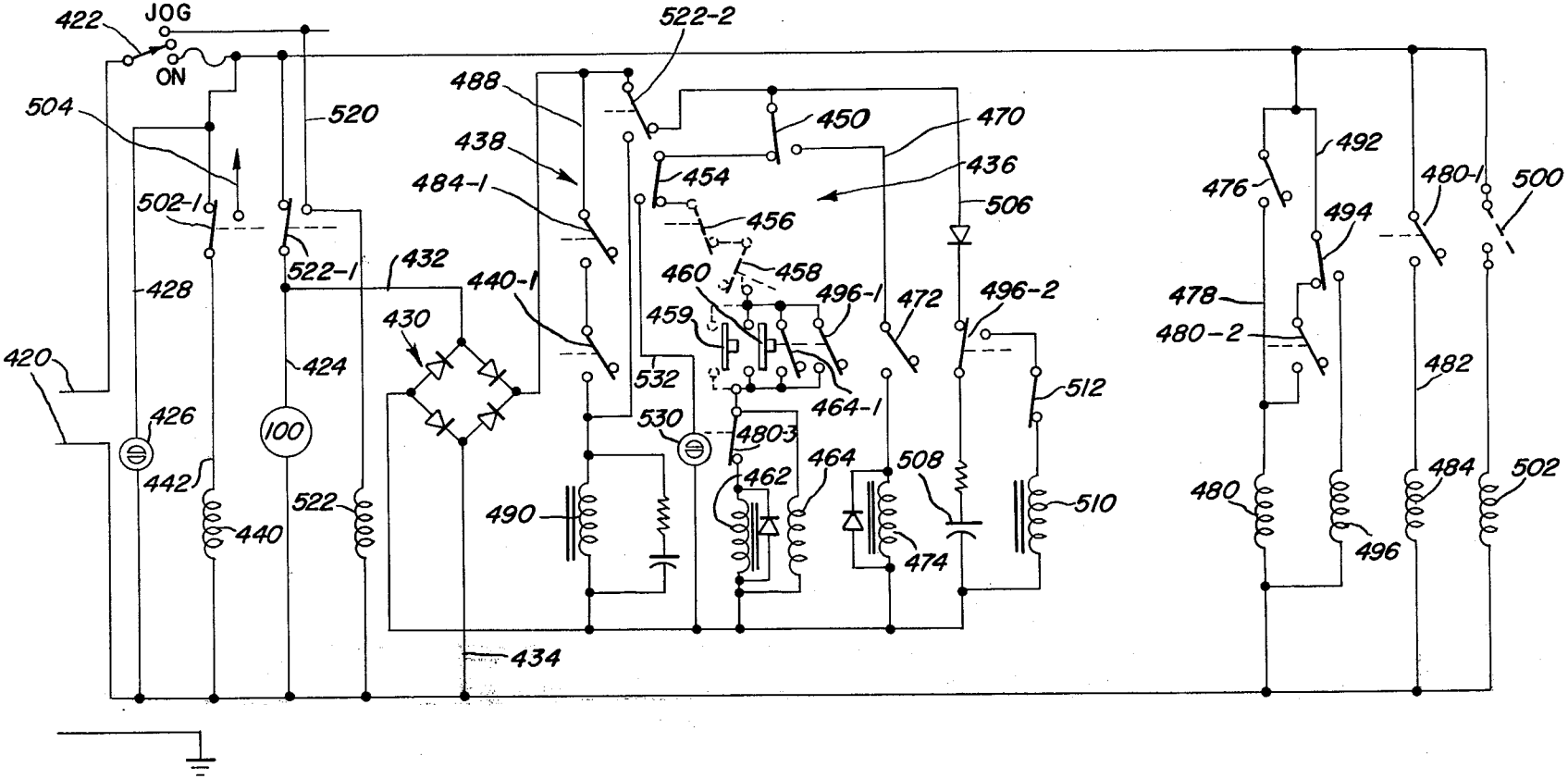
FIG. 11 is a modified form of electric circuits for the embodiments of the invention shown in FIGS. 9 and 10.

The document feeding mechanism shown in FIG. 10 incorporates the electric circuit shown schematically in FIG. 11. The electric circuit includes a power supply 420 that may be connected to the document feeding circuit in either an automatic or manual cycle through jog switch 422. Movement of the switch 422 to the automatic or on position will energize motor 100 through line 424. An on light 426 will also be energized through line 428. In addition, bridge 430 will be energized through lines 432 and 434 to energize document feeding circuit 436 and gate circuit 438. Also relay 440 is energized through line 442 and contact 440-1 in gate circuit 438 is closed to condition the circuit for operation.

The actuation of motor 100 will continuously drive the endless or transport belts 50 and 401, as well as the backup rolls 72 and 94. The motor is also operatively connected through solenoids that cooperate with the printing rolls or heads 76 and 94 when the solenoids are actuated, as will be described later, as well as clutch 124 forming part of feed means 12.

The feeding circuit 436 includes a switch 450 carried by a rod 451 and switch 450 which has an actuating arm 452 located in the path of movement of the documents adjacent the feeding mechanism 12. The feeding circuit also includes a document supply sensing switch 454, similar to switch 234 in the embodiment of FIG. 2, which senses the presence or absence of documents in the source 14. When documents are present in the source 14, the switch is in the position shown in FIG. 11 and energy is supplied through switches 456 and 458 (to be described later) to a plurality of parallel switches. One of the parallel switches is manual switch 460 that is actuated to initiate the feeding of documents from the source 14. When mamual switch 460 is actuated, relay 462 is energized and cooperates with clutch 124 in the feeding mechanism to rotate feed roller 32 and feed a first document from the stack to the path defined by belts 401 and back up roll 72. At the same time relay 462 is energized, relay 464 is simultaneously energized to close contacts 464-1 that are parallel to switch 460 to continue to maintain relay 462 energized. When the first document reaches the switch arm 452, switch 450 is actuated and moved to the second position from that shown in FIG. 11 which de-energizes the feed circuit 436 and supplies power to line 470 that is connected through manual switch 472 to relay 474 that forms part of a solenoid cooperating with print roll of head 76. If the manual switch 472 is closed, relay 474 will be energized to cause the printing head 76 to be rotated and print the document as it is moving between the backup roll 72 and the printing roll 76.

It should be noted that, when feed circuit 436 is de-energized, the document is already gripped between continuously driven backup roll 72 and belts 401 so that the document continues its movement along the path.

At the same time a second switch 476 located adjacent switch 450 is actuated by the moving docment and completes a circuit through line 478 to relay 480. Relay 480 has a contact 480-1 located in a line 482 that has time delay 484 located therein. Time delay relay 484 is part of the gate circuit and has a normally open contact 484-1 located in line 488 leading to relay 490. Time delay relay 484 closes contact 484-1 a predetermined period of time after the relay is actuated, and the time may be set as explained above in connection with the first embodiment described.

When contact 484-1 is closed, relay 490 is energized to rotate shaft 60 a sufficient amount to allow the document to continue moving along the path after it has been squared at the sqauring gate. The shaft 60 is then rotated in the opposite direction and returned to the position shown in FIG. 10.

Relay 480 also has contact 480-2 in a line 492 parallel to line 478 to maintain relay 480 energized. In addition, relay 480 has a third contact 480-3 located in the line leading to solenoid 462 that cooperates with clutch 124 to de-energize relay 462 and prevent the feeding of a subsequent document even though switch 450 returns to its closed condition.

When the gate arm cooperating with shaft 60 is actuated by the closing contacts 484-1 an appropriate time after relay 484 is energized, the first document proceeds along the path downstream of the gate means 24. The rotation of shaft 60 will actuate a switch 494 (FIG. 10) located adjacent the shaft and switch 494 is located in line 492 and is moved to a second position shown in FIG. 11 to energize relay 496. The movement of the switch 494 to the second position also de-energized relay 480 to close contacts 480-3 and open contacts 480-1.

The energizing of relay 496 closes contacts 496-1 in feed circuit 436 to re-energize solenoid 462 and feed a second document from source to the path.

It should be noted at this point that the electric circuit incorporates a switch mechanism that prevents gate means 24 from being actuated if a preceding document has not reached a predetermined position downstream of the gate means. This mechanism also is capable of actuating the feeding circuit in response to the condition of a machine to which the documents are fed. In the illustrated embodiment, this mechanism includes a switch 500 in the form of a photoelectric cell that is located in the machine to which the documents are being fed. If there is no document located adjacent switch 500, the switch is in an open condition shown in FIG. 11. However, if a document is present in this area, switch 500 is in a closed condition and completes a circuit to relay 502. Relay 502 has contact 502-1 located in line 442 and contact 502-1 is moved to a second position from that shown in FIG. 11 when relay 502 is energized. This will de-energize relay 440 and open contacts 440-1 in the line 488 to prevent solenoid 490 from being energized which in turn will prevent the gate means from being actuated. In the second position of contact 502-1 relay 440 is connected to line 504 which leads from the machine to which the documents are fed. When a command is sent to line 504, energizing this line, relay 440 will be energized to close contact 440-1 and energize solenoid 490 if the time delay has timed out and contact 484-1 is closed. This will actuate gate means 24 which in turn will energize relay 496, as explained above the close contact 496-1 and feed another document.

When the circuit is operated to feed only in response to movement of the documents within the document feeding device, switch 500 prevents gate means 24 from being actuated until the first document has passed beyond switch 500. While the first document holds switch 500 closed contact 502-1 remains open to prevent relay 440 from being energized.

Relay 496 also has contact 496-2 located in line 506 that also has a capacitor 508 located therein. When relay 496 is de-energized, switch contact 496-2 is in the position shown in FIG. 11 wherein power is supplied to capacitor 508 to charge the capacitor. When relay 496 is energized, contact 496-2 moves to the second position to connect capacitor 508 to relay 510 if manual switch 512 is in a closed condition. The solenoid having relay 510 therein rotates the printing roll or head 92 to print the document as it is passing between rolls 92 and 94.

The circuit shown in FIG. 11 also incorporates mechanism for clearing the machine of all documents. For this purpose, switch 422 has a second or jog position wherein power is supplied to line 520, which has relay 522 located therein. Relay 522 has a first contact 522-1 that is moved to a second position when relay 522 is energized to continue operation of motor 100. Relay 522 also actuates contact 522-2 that directly connects the bridge 430 to solenoid 490 to thereby hold the gate in an open position. With the switch in the jog position, the gate solenoid 490 will remain energized while the motor will continue to operate so that all of the documents in the path will move out of the machine.

The circuit shown in FIG. 11 also incorporates indicator means for advising the operator that the supply of documents is depleted. This indicator means includes a light 530 in line 532 which has a contact adjacent switch 454. When the supply of documents is depleted, switch 454 is moved from the solid line position shown in FIG. 11 to de-energize the feed circuit 436 and energize light 530.

The initiation of feeding documents may also be controlled in response to activation of the machine to which the documents are fed. For this purpose, feed circuit 436 has an additional switch 536 parallel to manual switch 460. Thus, when switch 536 is actuated, after the feed circuit has been energized, the initial document is fed from the source to the path. When controlling the feeding of documents as a function of the condition of the machine to which the documents are being fed, the switches 456 and 458 act as safety switches to prevent feeding of documents when certain conditions are not met.

Figure 8:
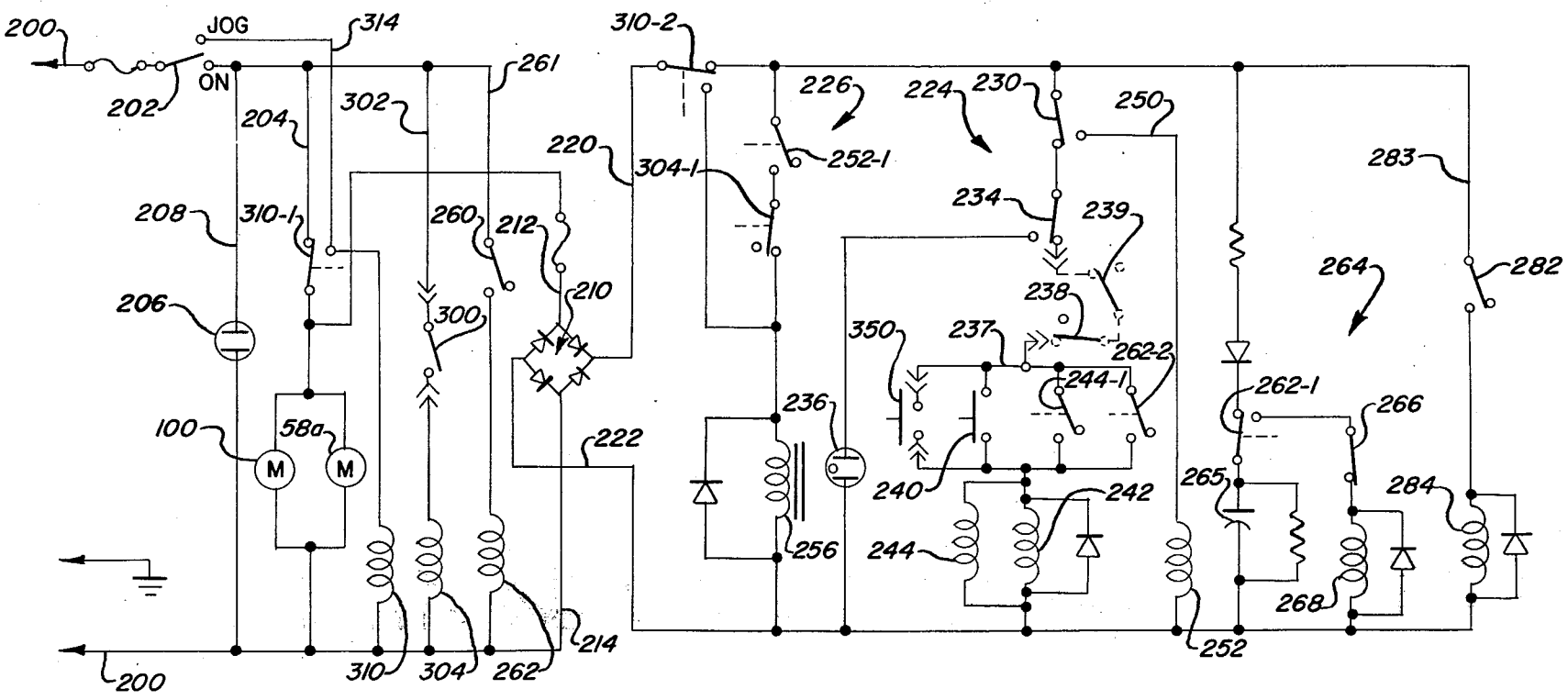
FIG. 8 is an electrical schematic diagram of the circuit incorporated into the device.

It is believed that the operation of the modified circuit has been sufficiently described in connection with the details of the circuitry and, since the basic operation of this circuit is in many respects similar to the circuits shown in FIG. 8, no detailed summary thereof appears to be necessary.

It should be noted that while two separate switches 450 and 476 have been shown to respectively actuate the first endorsing or printing mechanism and the initiation of the time delay, the functions of these two switches could be incorporated into a single switch having plural contacts to perform these separate functions.

Also, it will be readily apparent that numerous modifications and variations come to mind without departing from the spirit of the invention.

For example, the vacuum belt conveying means shown in the embodiment of FIG. 2 could readily be incorporated into the embodiment shown in FIG. 10. Also, the embodiment of FIG. 10 could have the printing or endorsing mechanisms both located downstream of the gate means which would only require minor modifications to the circuit shown in FIG. 11.

We claim:

1. A document feeding device comprising selectively actuated feeding means adapted to sequentially deliver documents from a source to a feed path; continuously operating means for moving said documents along said feed path; aligning means along said feed path for temporarily interrupting the movement of each of said documents along said feed path and for aligning each of said documents relative to said feed path; control means responsive to the presence of documents in said feed path for effecting actuation of said aligning means to allow said continuously operating document moving means to move each of said aligned documents further along said feed path and for effecting actuation of said feeding means to feed a subsequent document to said feed path; printing means along said path for printing indicia on said documents, said printing means being disposed downstream of said aligning means; and means for actuating said printing means in response to actuation of said aligning means.

2. A document feeding device as defined in claim 1, in which said printing means includes first and second printing mechanisms, and including means for actuating said first printing mechanism in response to actuation of said aligning means and means for actuating said second printing mechanism in response to actuation of said first printing mechanism.

3. A document feeding device as defined in claim 2, further including endless belt means defining said path; common drive means for continuously driving said endless belt means, said common drive means being connectible to said feeding means, said aligning means and said printing mechanisms for intermittently driving said feeding means, said aligning means, and said printing mechanisms.

4. A document feeding device as defined in claim 2, further including endless belt means defining said path, means defining an apertured vacuum chamber adjacent said endless belt means, and means for producing a vacuum in said chamber to maintain said documents in contact with said endless belt means.

5. A document feeding device comprising selectively actuated feeding means adapted to sequentially deliver documents from a source to a feed path; continuously operating means for moving said documents along said feed path; aligning means along said feed path for temporarily interrupting the movement of each of said documents along said feed path and for aligning each of said documents relative to said feed path; control means responsive to the presence of documents in said feed path for effecting actuation of said aligning means to allow said continuously operating document moving means to move each of said aligned documents further along said feed path and for effecting actuation of said feeding means to feed a subsequent document to said feed path; said control means including document sensing means for sensing the presence of a document along said feed path and means for effecting actuation of said aligning means a selected time period thereafter; and second document sensing means for sensing the presence of a document at a selected position downstream of said aligning means and for preventing actuation of said aligning means while a document is at said selected position.

6. A document feeding device comprising selectively actuated feeding means adapted to sequentially deliver documents from a source to a feed path; continuously operating means for moving said documents along said feed path; aligning means along said feed path, for temporarily interrupting the movement of each of said documents along said feed path and for aligning each of said documents relative to said feed path, control means responsive to the presence of documents in said feed path for effecting actuation of said aligning means to allow said continuously operating document moving means to move each of said aligned documents further along said feed path and for effecting actuation of said feeding means to feed a subsequent document to said feed path; said feeding control means including document sensing means for sensing the presence of a document along said feed path, means for effecting actuation of said aligning means a selected time period thereafter, and means responsive to actuation of said aligning means for actuating said feed means to feed a subsequent document to said path.

7. A document feeding device comprising selectively actuated feeding means to sequentially deliver documents from a source to a feed path; continuously operating means for moving said documents along said feed path; said document moving means including a plurality of continuously moving first belts and a plurality of continuously moving second belts together defining said feed path and located respectively above and below said feed path for gripping said documents therebetween and for moving said documents along said feed path; aligning means along said feed path for temporarily interrupting the movement of each of said documents along said feed path and for aligning each of said documents relative to said feed path; control means responsive to the presence of documents in said feed path for effecting actuation of said aligning means to alllow said continuously operating document moving means to move each of said aligned documents further along said feed path and for effecting actuation of said feeding means to feed a subsequent document to said feed path; and first and second printing means disposed along said feed path, said first printing means being located between said source and said document aligning means and said second printing means being located downstream of said document aligning means.

8. A document feeding device comprising selectively actuated feeding means adapted to sequentially deliver documents from a source to feed path; continuously operating means for moving said documents along said feed path, said document moving means including a plurality of continuously moving first belts and a plurality of continuously moving second belts together defining said feed path and located respectively above and below said feed path for gripping said documents therebetween and for moving said documents along said feed path; aligning means along said feed path for temporarily interrupting the movement of each of said documents along said feed path and for aligning each of said documents relative to said feed path; control means responsive to the presence of documents in said feed path for effecting actuation of said aligning means to allow said continuously operating document moving means to move each of said aligned documents further along said feed path and for effecting actuation of said feeding means to feed a subsequent document to said feed path; said control means including first document sensing means for sensing a document fed to said feed path and for effecting actuation of said document aligning means in response thereto, and switch means responsive to actuation of said document aligning means for effecting actuation of said feed means to feed a subsequent document to said feed path.

9. A document feeding device comprising selectively actuated feeding means adapted to sequentially deliver documents from a source to a feed path; continuously operating means for moving said documents along said feed path; aligning means along said feed path for temporarily interrupting the movement of each of said documents along said feed path and for aligning each of said documents relative to said feed path; control means responsive to the presence of documents in said feed path for effecting actuation of said aligning means to allow said continuously operating document moving means to move each of said aligned documents further along said feed path and for effecting actuation of said feeding means to feed a subsequent document to said feed path; printing means disposed along said feed path, said printing means including a first printing mechanism located between said feeding means and said document aligning means; said document moving means including a first set of belts cooperating with said first printing mechanism to define a first portion of said feed path, and second and third sets of belts above and below said feed path defining the remainder of said feed path; and means responsive to said control means for actuating said printing means.

10. A document feeding device as defined in claim 9, in which said printing means includes second printing mechanism located downstream of said document alinging means and said control means includes first and second switch means between said feeding means and said gate means for respectively actuating said gate means and said first printing mechanism and third switch means actuated by said aligning means for actuating said feeding means and said second printing mechanism.

11. A document feeding device comprising selectively actuated feeding means adapted to sequentially deliver documents from a source to a feed path; continuously operating means for moving said documents along said feed path; aligning means along said feed path for temporarily interrupting the movement of each of said documents along said feed path and for aligning each of said documents relative to said feed path; control means responsive to the presence of documents in said feed path for effecting actuation of said aligning means to allow said continuously operating document moving means to move each of said aligned documents further along said feed path and for effecting actuation of said feeding means to feed a subsequent document to said feed path; printing means disposed along said feed path, and means responsive to said control means for actuating said printing means; said printing means including first and second printing mechanisms located at spaced locations along said feed path downstream of said aligning means; said control means including first switch means between said feeding means and said aligning means for actuating said aligning means, second switch means actuated by said aligning means for actuating said feeding means, third switch means actuated by said aligning means for actuating said first printing mechanism and fourth switch means actuated by said first printing mechanism for actuating said second printing mechanism.

12. Apparatus for automatically feeding documents sequentially along a path and aligning the leading edges normal to the path, comprising continuously driven document moving means defining said path; feeding means for sequentially removing documents from a stack and depositing the documents on said document moving means; gate means adjacent said moving means for engaging the leading edge of each document to interrupt the movement of the document along said path to position the leading edge normal to said path; control means cooperating with said path for sensing for sensing the position of a document along said path; first means responsive to said control means for moving said gate means to allow the interrupted document to continue movement along the path; and second means responsive to said control means and said gate means for actuating said feeding means to remove a further document from the stack and feed the document to said moving means.

13. Apparatus as defined in claim 12, further including common drive means including a motor connected to said moving means for continuously driving said moving means and in which said first means includes solenoid means for operating said gate means and said second means includes clutch means between said motor and said feed means.

14. Apparatus as defined in claim 13, in which said control means includes switch means along said path for sensing the presence of a document along said path between said feeding means and said gate means, said switch means actuating time delay means cooperating with said solenoid means, said time delay means effecting actuation of said solenoid means and said clutch means a selected period after actuation of said time delay means.

15. Apparatus as defined in claim 14, further including second switch means along said path downstream of said gate means, said second switch means cooperating with said time delay means to prevent actuation of said gate means until a document has reached a predetermined position with respect to said path.

16. A method of automatically feeding documents sequentially along a path and aligning the leading edge transversely of the path comprising the steps of periodically feeding a document from a stack; moving the document along the path by engaging the document with a continuously moving conveyor means; positioning a gate transversely of the path to briefly interrupt the forward motion of the document and align the leading edge transversely of the path; producing a signal as a function of the document moving past a predetermined position along the path; temporarily moving the gate as a function of the signal to allow said continuously moving conveyor means to continue moving the first document along the path; feeding another document from the stack to the path as a function of the signal; sensing the position of a document along the path downstream of the gate; and preventing movement of the gate until the previous document had reached a predetermined position downstream of the gate.

17. The method as defined in claim 16, including the further step of sensing the presence of documents in the stack and rendering the feeding mechanism inoperative when no documents are present in the stack.

* * * * *